US006240886B1

(12) United States Patent
Noguchi

(10) Patent No.: US 6,240,886 B1
(45) Date of Patent: Jun. 5, 2001

(54) STRATIFIED SCAVENGING TWO-CYCLE ENGINE

(75) Inventor: Masanori Noguchi, Higashimurayama (JP)

(73) Assignees: Komatsu Zenoah Co., Kawagoe; Petroleum Energy Center, Tokyo, both of (JP)

( * ) Notice: Subject to any disclaimer, the term of this patent is extended or adjusted under 35 U.S.C. 154(b) by 0 days.

(21) Appl. No.: 09/284,430

(22) PCT Filed: Oct. 15, 1997

(86) PCT No.: PCT/JP97/03712

§ 371 Date: Apr. 12, 1999

§ 102(e) Date: Apr. 12, 1999

(87) PCT Pub. No.: WO98/17903

PCT Pub. Date: Apr. 30, 1998

(30) Foreign Application Priority Data

Oct. 17, 1996 (JP) ..... 8-274982

(51) Int. Cl.[7] ..... F02B 33/04
(52) U.S. Cl. ..... 123/73 AA; 123/73 R
(58) Field of Search ..... 123/73 R, 73 AA, 123/73 PP

(56) References Cited

U.S. PATENT DOCUMENTS

| | | | | |
|---|---|---|---|---|
| 4,075,985 | | 2/1978 | Iwai | 123/73 |
| 4,195,600 | * | 4/1980 | Shingai | 123/73 AA |
| 4,458,636 | * | 7/1984 | Kania | 123/73 AA |
| 4,964,382 | | 10/1990 | Kikuchi | 123/73 |
| 5,934,230 | * | 8/1999 | Uytdewilligen | 123/73 R |

FOREIGN PATENT DOCUMENTS

| | | |
|---|---|---|
| 52-170913 | 12/1977 | (JP) . |
| 58-19304 | 4/1983 | (JP) . |
| 60-119327 | 6/1985 | (JP) . |
| 61-184824 | 11/1986 | (JP) . |
| 2-108836 | 4/1990 | (JP) . |

* cited by examiner

*Primary Examiner*—John Kwon
(74) *Attorney, Agent, or Firm*—Sidley & Austin

(57) ABSTRACT

The present invention is a stratified scavenging two-cycle engine which can make exhaust gas cleaner. For this purpose, in a stratified scavenging two-cycle engine, which includes a scavenging flow passage (3) to connect a cylinder chamber (4*a*) and a crank chamber (1*a*) and an air flow passage (2) connected to the scavenging flow passage (3), is constructed so that pressure reduction in a crank chamber (1*a*) following an upward movement of a piston (7) permits air to be drawn into the scavenging flow passage (3) from the air flow passage (2) and a scavenging port (3*a*), at which the scavenging flow passage (3) is opened to a cylinder inner surface (4*b*), is not fully obstructed by a side wall of the piston (7) and communicates with the crank chamber (1*a*).

9 Claims, 5 Drawing Sheets

STRATIFIED SCAVENGING TWO-CYCLE ENGINE

TECHNICAL FIELD

The present invention relates to a stratified scavenging two-cycle engine which takes in a fluid mixture and air separately.

BACKGROUND ART

Conventionally, as shown in FIG. 4 and FIG. 5, a stratified scavenging two-cycle engine, having a fluid mixture flow passage (not shown) for supplying a fluid mixture is connected to a crankcase 1 and an air flow passage 2 for supplying air is connected to a scavenging flow passage 3, is known. A check-valve 20 is provided at the outlet port of the air flow passage 2. The check-valve 20 is composed of a reed valve and is constructed to permit a flow from the air flow passage 2 to the scavenging flow passage 3 and prevent a flow from the scavenging flow passage 3 to the air flow passage 2.

Meanwhile, the scavenging flow passage 3 extends between the crankcase 1 and a cylinder block 4 so as to allow communication between a crank chamber la and a cylinder chamber 4*a*. A scavenging port 3*a* leading to the scavenging flow passage 3 is opened to a cylinder inner surface 4*b*, and an exhaust port (not shown) is opened thereto for exhausting combustion gas.

Further, the crankcase 1 is provided with a crankshaft 5, and a piston 7 is coupled to the crankshaft 5 with a connecting rod 6 between them. The piston 7 is fitted in the cylinder inner surface 4*b* and freely moves along an axial direction of the cylinder inner surface 4*b*. Further, the cylinder block 4 is provided with a cylinder head 8, which is provided with an ignition plug 9.

In the stratified scavenging two-cycle engine configured as above, as the piston 7 ascends, the pressure inside the crank chamber 1*a* starts to drop, and the scavenging port 3*a* and the exhaust port are sequentially closed. As a result, the fluid mixture in the cylinder chamber 4*a* is compressed, and the fluid mixture supplied from the fluid mixture flow passage is passed into the crank chamber 1*a*. In this situation, air also enters the crank chamber 1*a* through the scavenging flow passage 3 from the air flow passage 2.

When the piston 7 reaches an area in the vicinity of an upper-most position, the fluid mixture in the cylinder chamber 4*a* is ignited by means of the ignition plug 9, and thereby the pressure inside the cylinder chamber 4*a* rises and the piston 7 descends. When the piston 7 descends to a predetermined position, the exhaust port and the scavenging port 3*a* are sequentially opened. As a result of the exhaust port being opened, combustion gas is exhausted from the exhaust port, thereby the pressure inside the cylinder chamber 4*a* abruptly drops. As a result of the scavenging port 3*a* being opened, the air accumulated in the scavenging flow passage 3 spurts into the cylinder chamber 4*a* from the scavenging port 3*a*, and the combustion gas staying in the cylinder chamber 4*a* is compulsorily discharged from the exhaust port by the air. Thereafter, the fluid mixture in the crank chamber 1*a* enters the cylinder chamber 4*a* through the scavenging flow passage 3 from the scavenging port 3*a*. Thus the scavenging operation is completed.

Again the piston 7 ascends, and the aforesaid cycle is repeated once more.

According to the stratified scavenging two-cycle engine configured as above, the inside of the cylinder chamber 4*a* is scavenged first by air, and combustible gas is prevented from being discharged as a result of the fluid mixture blowing through, therefore obtaining a disadvantage that the exhaust gas is uncleaned.

In the aforesaid stratified scavenging two-cycle engine, a portion of the fluid mixture stays inside the scavenging flow passage 3 at a point in time when scavenging is completed, but most of the remaining fluid mixture is forced out toward the crank chamber 1*a* by the air supplied from the air flow passage 2 and is replaced by fresh air. The fluid mixture remaining at the exhaust port 3*a* of the scavenging flow passage 3, however, cannot be forced out toward the crank chamber 1*a* and stays there as is. As a result, at the time of starting scavenging, fluid mixture remaining at the scavenging port 3*a* enters the cylinder chamber 4*a*, and the fluid mixture blows out of the exhaust port, thereby causing the disadvantage in the form of unclean exhaust gas.

SUMMARY OF THE INVENTION

The present invention is made to eliminate the aforesaid disadvantage, and its object is to provide a stratified scavenging two-cycle engine which can make exhaust gas cleaner.

In order to attain the aforesaid object, a stratified scavenging two-cycle engine according to the present invention is a stratified scavenging two-cycle engine, which includes a scavenging flow passage to connect a cylinder chamber and a crank chamber, and an air flow passage connected to the scavenging flow passage, and which is constructed so that pressure reduction in the crank chamber following an upward movement of a piston permits air to be drawn into the scavenging flow passage from the air flow passage, and is characterized in that a scavenging port, at which the scavenging flow passage is opened to a cylinder inner surface, is clear of a side wall of the piston and communicates with the crank chamber in a state when the piston is positioned at least at an upper-most position.

According to the above configuration, when the piston ascends, the pressure inside the crank chamber reduces, and for example, a fluid mixture flows into the crank chamber while air flows into the scavenging flow passage from the air flow passage. During a stroke in which air is taken in, the scavenging port, which is opened to the inner surface of the cylinder, communicates with the crank chamber in such a manner as to avoid being fully obstructed by the side wall of the piston. As a result, air taken into the scavenging flow passage flows into the crank chamber through the scavenging port. Accordingly, the scavenging flow passage is filled with air at least at the scavenging port side to remove a residual fluid mixture.

Next, when the piston descends as a result of the mixture being ignited, the scavenging port is closed and the pressure inside the crank chamber increases. When the piston descends by a predetermined amount, for example, the exhaust port opens, combustion gas then flows out of the exhaust port, the pressure in the cylinder chamber abruptly drops, and the scavenging port is opened. Air flows into the cylinder chamber from the scavenging port, and the fluid mixture inside the crank chamber then flows into the cylinder chamber from the scavenging port through the scavenging flow passage.

As described above, the scavenging flow passage is filled with air at least at the scavenging port side, therefore at a point in time at which scavenging is started, only air first flows into the cylinder chamber, and combustion gas is expelled from the exhaust port. Accordingly, a fluid mixture is prevented from blowing through, and exhaust gas can be made cleaner.

Next, the aforesaid scavenging port may be opened at a position lower than the bottom end of the piston when it is positioned at least at an upper-most position. According to the aforesaid configuration, in a process in which the piston reaches the upper-most position, the scavenging port opens, and air flows into the cylinder chamber from the scavenging port. The scavenging port may be formed so as to open only by a small amount from the bottom end of the piston, therefore providing an advantage of a simple structure.

Further, the aforesaid piston may be constructed to have a through-hole which is formed so as to allow communication between the scavenging port and the crank chamber in a state when the piston is positioned at least at an upper-most position. According to this configuration, in a process in which the piston reaches the upper-most position, the through-hole which is formed at the piston communicates with the scavenging port, and the scavenging port communicates with the crank chamber through the through-hole. As a result, even though the length of the piston in an axial direction is made long, the scavenging port can be connected to the crank chamber via the through-hole. Accordingly, a so-called oscillating movement of the piston can be controlled.

Furthermore, the aforesaid piston may be constructed to have a notch which is formed so as to allow communication between the scavenging port and the crank chamber in a state when the piston is positioned at least at an upper-most position. According to the above configuration, the scavenging port can be connected to the crank chamber by means of the notch formed at the piston; therefore, the length of the piston in an axial direction may remain long. Accordingly, as described above, the so-called oscillating movement of the piston can be controlled.

BEST MODE FOR CARRYING OUT THE INVENTION

Figure 1:
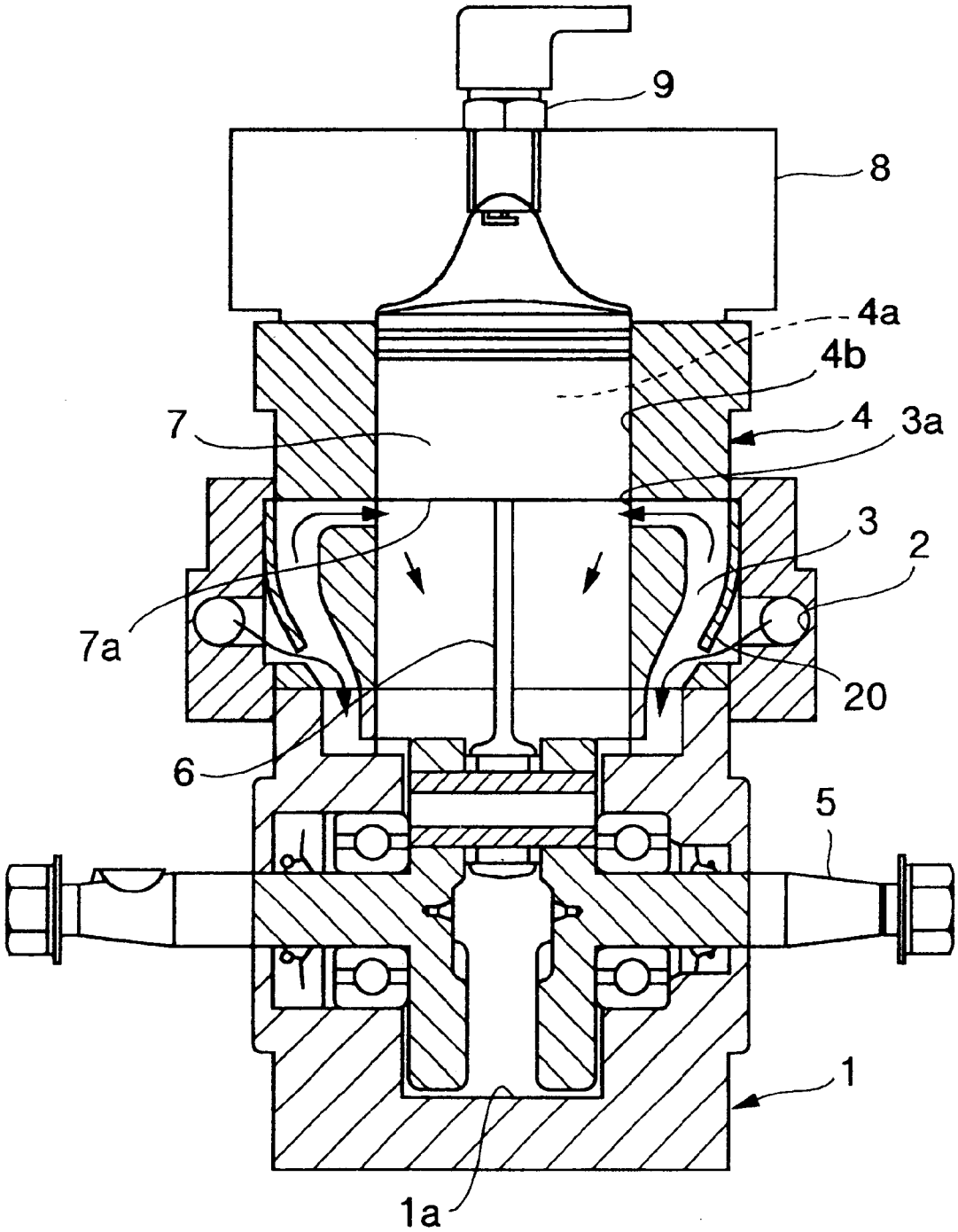
FIG. 1 is a sectional view of a stratified scavenging two-cycle engine shown as a first embodiment of the present invention.
Figure 2:
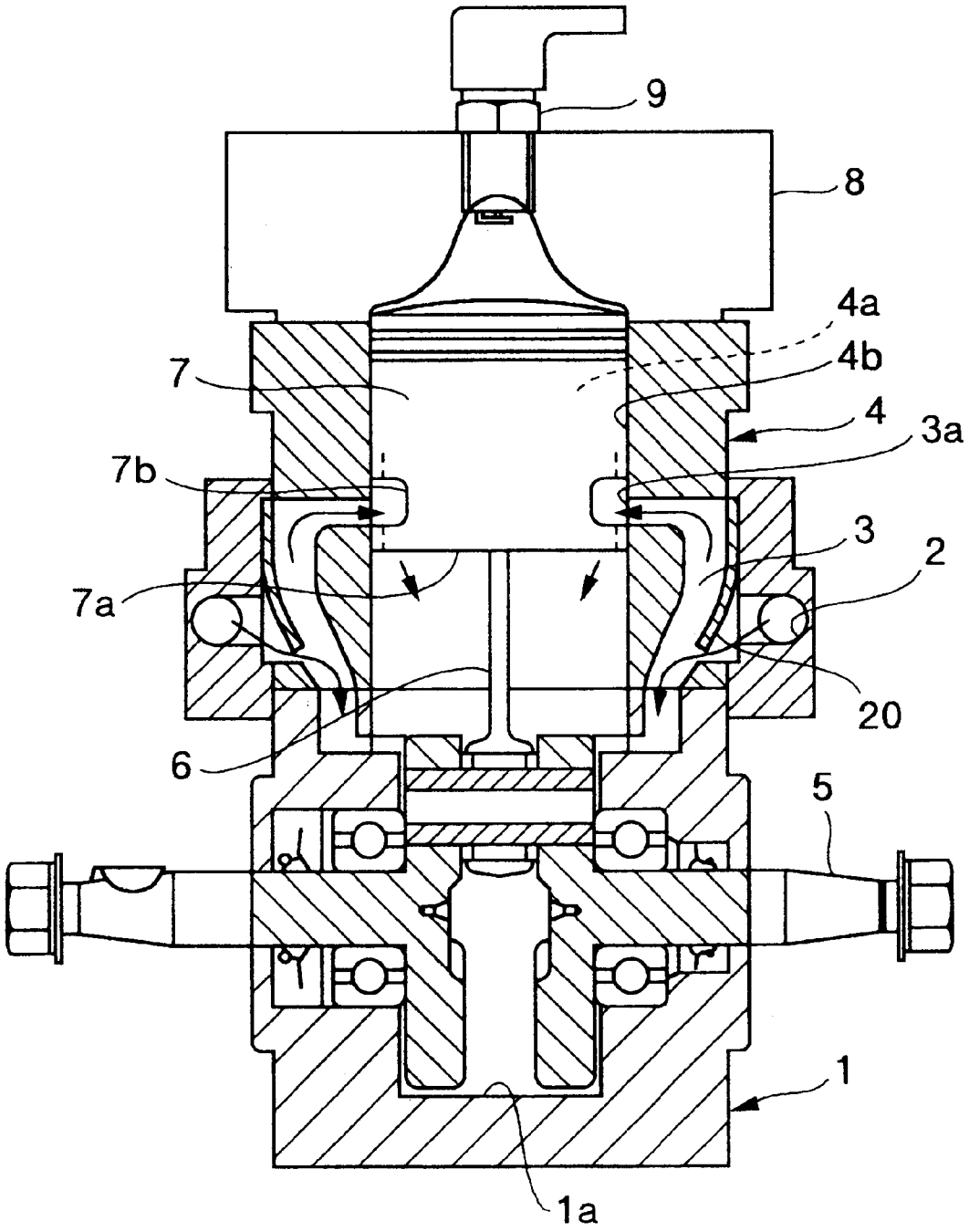
FIG. 2 is a sectional view of a stratified scavenging two-cycle engine shown as a second embodiment of the present invention.
Figure 3:
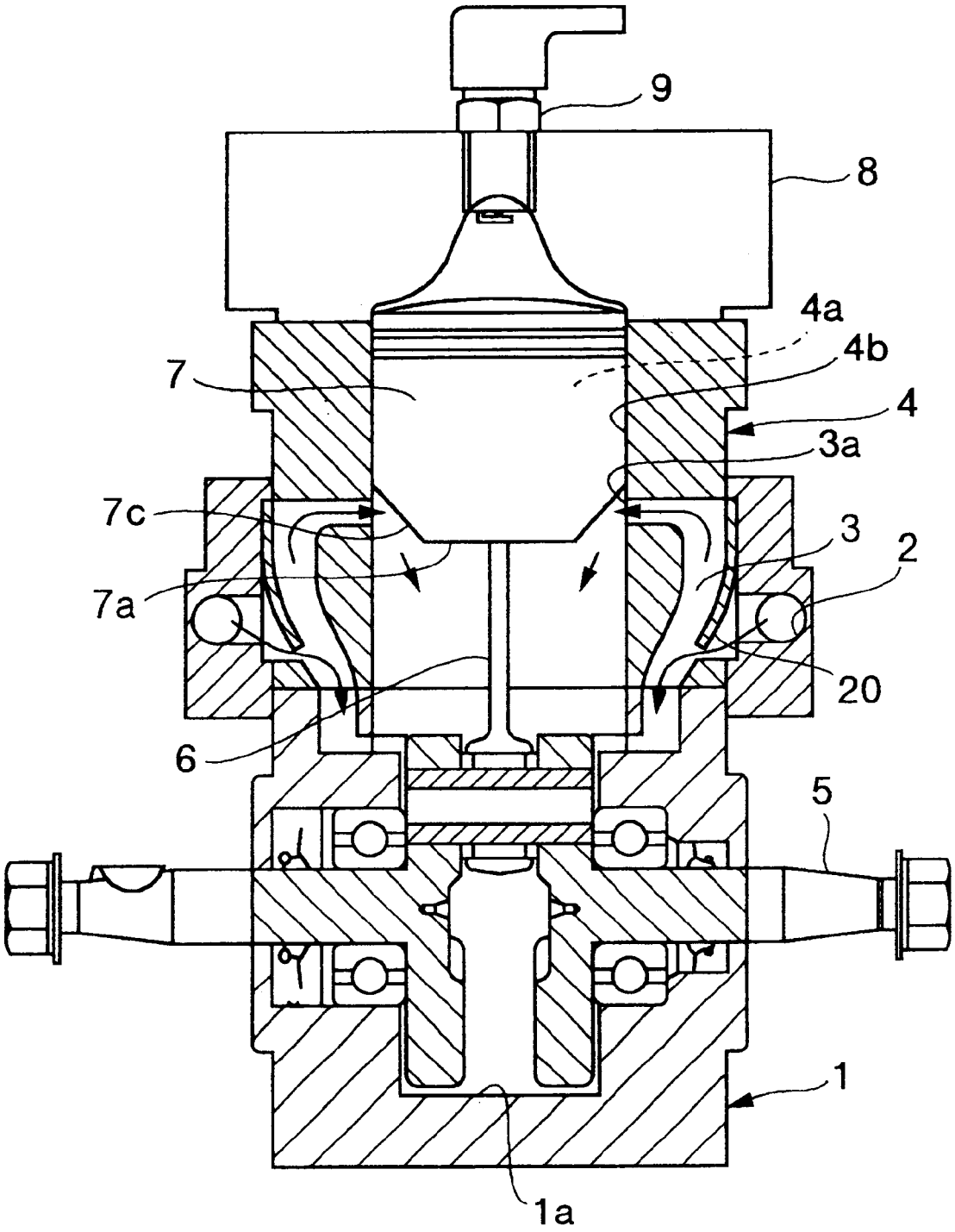
FIG. 3 is a sectional view of a stratified scavenging two-cycle engine shown as a third embodiment of the present invention.

Preferred embodiments according to the present invention will now be explained with reference to FIG. 1 to FIG. 3. FIG. 1 shows a first embodiment, FIG. 2 shows a second embodiment, and FIG. 3 shows a third embodiment.

Figure 4:
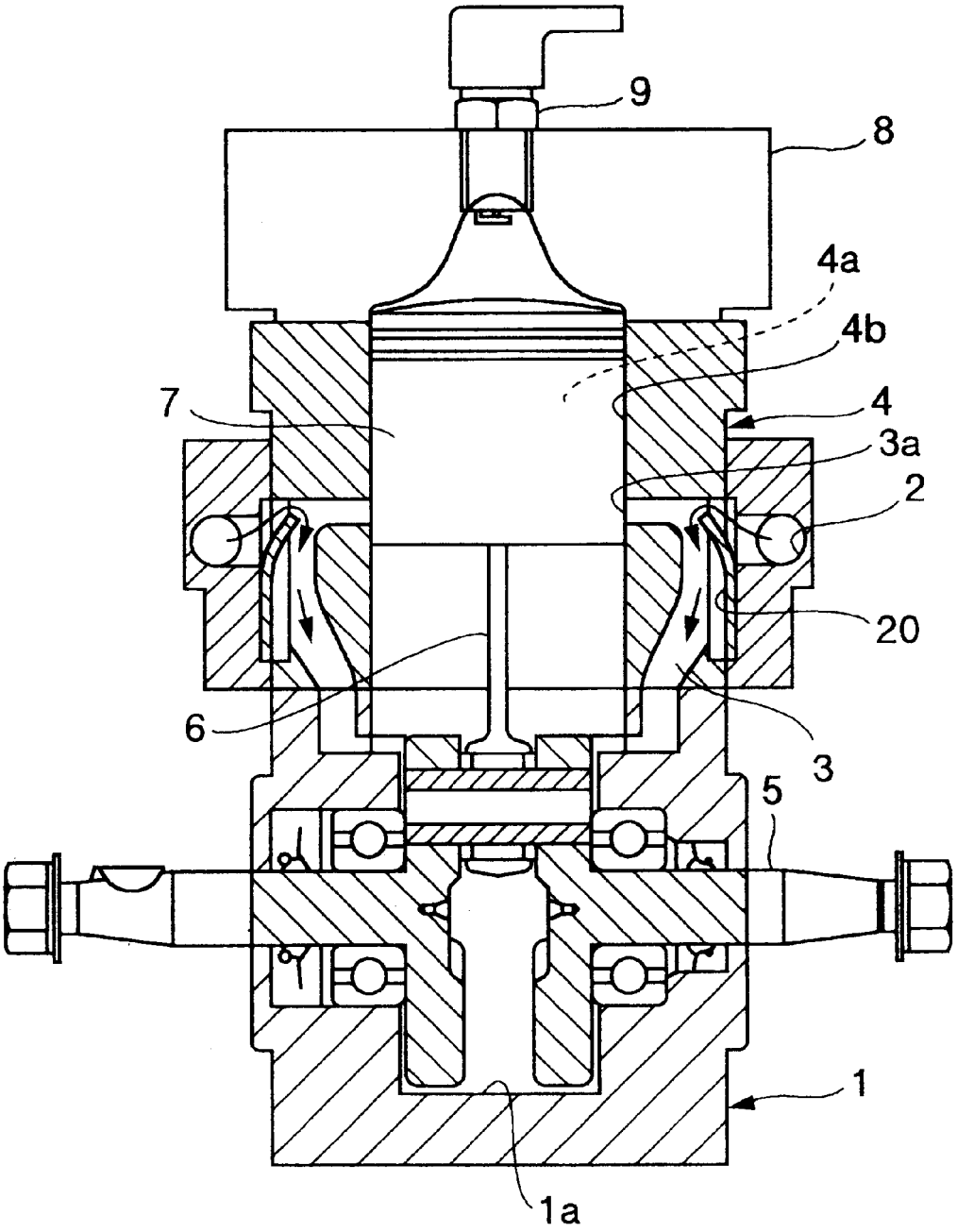
FIG.4 PRIOR ART
FIG. 4 is a sectional view of a conventional stratified scavenging two-cycle engine.
Figure 5:
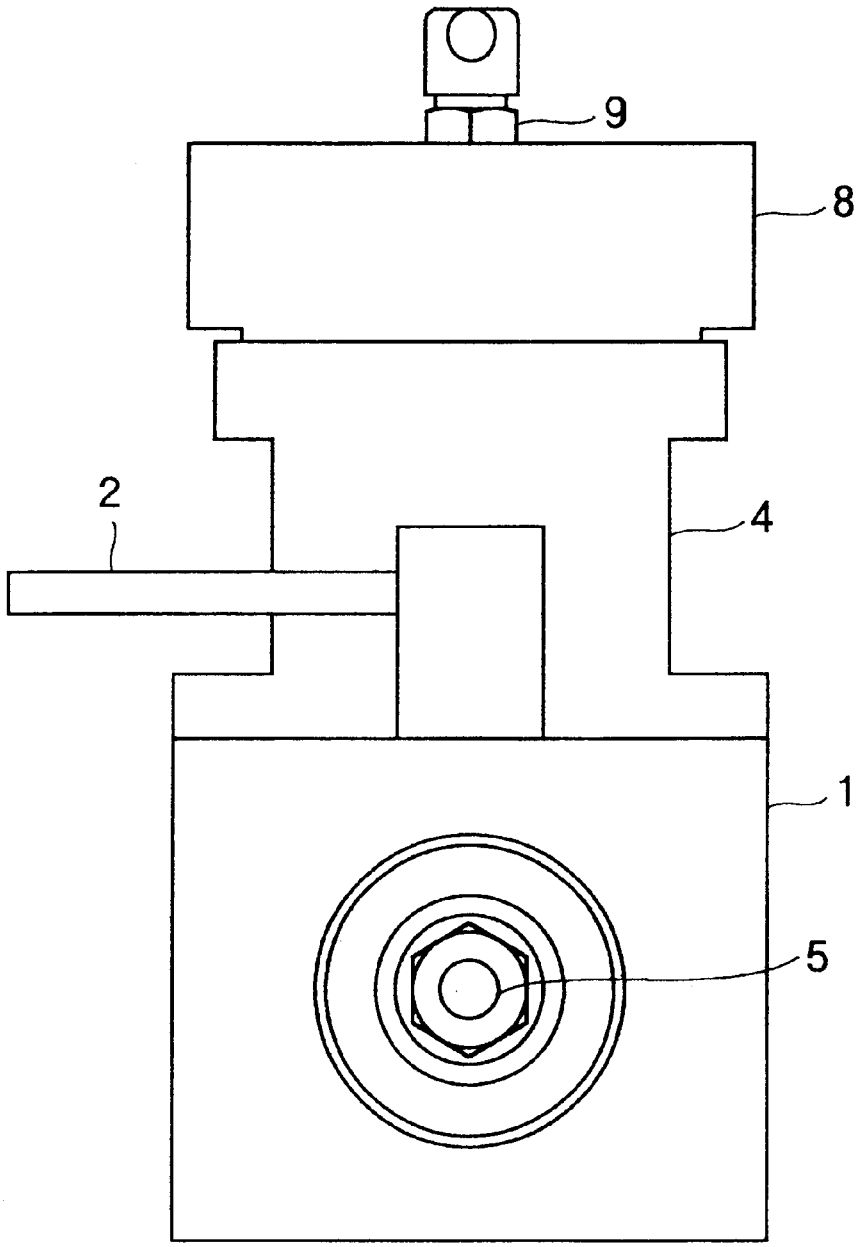
FIG.5 PRIOR ART
FIG. 5 is a side view of the stratified scavenging two-cycle engine of FIG. 4.

At first, the first embodiment will be explained with reference to FIG. 1. It should be mentioned that elements common to the prior art shown in FIG. 4 and FIG. 5 are given the same numerals and symbols, and the explanation thereof will be simplified. The first embodiment differs from the prior art in a point that a scavenging port 3*a* is opened at a position lower than a bottom end 7*a* of a piston 7 which is positioned at an upper-most position. Specifically, as shown in FIG. 1, the upper end of the scavenging port 3*a* is positioned at the bottom end 7*a* of the piston 7 which is positioned at the upper-most position, and the entire scavenging port 3*a* is opened at a position lower than the piston 7.

In a stratified scavenging two-cycle engine configured as described above, when the piston 7 ascends, the pressure inside a crank chamber 1*a* reduces, and a fluid mixture flows into the crank chamber 1*a* through a fluid mixture flow passage (not shown) while air flows into the crank chamber 1*a* from an air flow passage 2 through a scavenging flow passage 3. During the air intake stroke, the scavenging port 3*a* communicates with the crank chamber 1*a* in such a manner as to avoid being fully obstructed by the side wall of the piston 7. As a result, the air taken into the scavenging flow passage 3 flows into the crank chamber 1*a* through the scavenging port 3*a*. Accordingly, the scavenging flow passage 3 is filled with air at the scavenging port 3*a* side.

Next, when the piston 7 descends, as a result of the fluid mixture being ignited, the scavenging port 3*a* is closed, thereby increasing the pressure inside the crank chamber 1*a*. When the piston 7 descends by a predetermined amount, for example, an exhaust port opens, and combustion gas flows out of the exhaust port, thereby abruptly reducing the pressure in a cylinder chamber 4*a*, and the scavenging port 3*a* opens, and air first flows into the cylinder chamber 4*a*. Subsequently, the fluid mixture in the crank chamber 1*a* flows into the cylinder chamber 4*a* from the scavenging port 3*a* through the scavenging flow passage 3.

The entire scavenging flow passage 3, including the scavenging port 3*a* side, is filled with air as described above, therefore at a point in time when the scavenging is started, only air flows into the cylinder chamber 4*a* at first, thereby expelling combustion gas from the exhaust port. Accordingly, the fluid mixture introduced during scavenging can be dramatically reduced, and exhaust gas can be made cleaner. In addition, the exhaust port 3*a* is only formed so as to be opened at a position lower than the bottom end 7*a* of the piston 7, therefore providing the advantage of a simple structure.

Further, in order to replace the fluid mixture in the vicinity of the scavenging port 3*a* with air, it becomes unnecessary to connect, for example, the air flow passage 2 to a position near the scavenging port 3*a* of the scavenging flow passage 3. For this reason, a connection portion of the air flow passage 2 and the scavenging flow passage 3, and a check-valve 20 can be provided at any positions in the scavenging flow passage 3. Specifically, design flexibility is increased. Accordingly, for example, cooling ability, compactness, and the like can be prevented from being lost by the connection portion of the air flow passage 2 and the scavenging flow passage 3, and the check-valve 20.

In the above embodiment, air can flow into the crank chamber 1*a* from the scavenging flow passage 3 without passing through the scavenging port 3*a*, or air can flow into the crank chamber 1*a* via scavenging port 3*a*, but it may be constructed so that air entering without passing through the scavenging port 3*a* is stopped before the crank chamber 1*a*. In short, it may be constructed so that air fills at least the scavenging port 3*a* side of the scavenging flow passage 3. However, if it is constructed so that air fills the entire scavenging flow passage 3, the advantage of providing a larger amount of air for scavenging can be obtained.

Next, a second embodiment will be explained with reference to FIG. 2. The elements common to the first embodiment shown in FIG. 1 are given the same numerals and symbols, and the explanation thereof will be simplified. The second embodiment differs from the first embodiment in that a through-hole 7*b* is formed in the side wall of the piston 7, and the through-hole 7*b* corresponds to the scavenging port 3*a* in a state that the piston 7 reaches an upper-most position.

Specifically, as shown in FIG. 2, the piston 7 has the through-hole 7*b* which is formed to connect the scavenging port 3*a* a with the crank chamber 1*a* in a state that the piston 7 is positioned at an upper-most position. As for the through-hole 7*b* in this second embodiment, in a state that the piston 7 is positioned at the upper-most position, a bottom edge of through-hole 7*b* is positioned at a bottom edge of the scavenging port 3*a*, and a top edge of through-hole 7*b* is at a position above a top edge of the scavenging port 3*a*. Specifically, the through-hole 7*b* is formed to be larger than the scavenging port 3*a*. However, it goes without saying that the size of the through-hole 7*b* may be adjusted to be an optimum opening area. The entire scavenging port 3*a* is opened through the through-hole 7*b* to connect to the crank chamber 1*a* in a state that the piston 7 is positioned at an upper-most position.

In the stratified scavenging two-cycle engine constructed as above, in a process in which the piston 7 reaches an upper-most position, the though-hole 7*b* formed at the piston 7 communicates with the scavenging port 3*a*, and the scavenging port 3*a* communicates with the crank chamber 1*a* via the through-hole 7*b*. As a result, even if the length of the piston 7 in an axial direction remains long, the scavenging port 3*a* can be connected to the crank chamber 1*a* via the through-hole 7*b*. Accordingly, a so-called oscillating movement of the piston 7 can be controlled. Other than this, operational effects similar to the first embodiment are obtained.

Next, a third embodiment will be explained with reference to FIG. 3. The elements common to those in the first embodiment will be given the same symbols, and the explanation thereof will be simplified. The third embodiment differs from the first embodiment in a point that a notch 7*c*, to allow the scavenging port 3*a* to remain open is formed at the side wall of the piston 7.

Specifically, as shown in FIG. 3, the piston 7 has the notch 7*c* which is diagonally formed at the bottom end 7*a* so as to connect the scavenging port 3*a* with the crank chamber 1*a* when the piston 7 is positioned at an upper-most position. As shown in the drawing, in this embodiment, as for the notch 7*c*, a top end of the notch 7*c* is at a position above a top edge of the scavenging port 3*a*. Specifically, the entire scavenging port 3*a* opens through the notch 7*c* to communicate with the crank chamber 1*a* when the piston 7 is positioned at an upper-most position. Further, the notch 7*c* is provided in a direction at a right angle to a direction in which a connecting rod 6 swings so as to oppose to each other. It is natural that the aforesaid notch 7*c* is adjusted to obtain an optimum timing.

In the stratified scavenging two-cycle engine constructed as described above, the notch 7*c* formed in the piston 7 allows the scavenging port 3*a* to communicate with the crank chamber 1*a*. As a result, even if the length of the piston 7 in an axial direction remains long, the scavenging port 3*a* can communicate with the crank chamber 1*a* via the notch 7*c*. Further, each of the notches 7*c* is positioned in a direction at a right angle to the direction in which the connecting rod 6 swings, therefore a so-called oscillating movement of the piston 7 can be controlled. Other than this, operational effects similar to the first embodiment can be obtained.

In each of the aforesaid embodiments, the entire scavenging port 3*a* is opened in a state where the piston 7 reaches an upper-most position, but in a state where the piston 7 is positioned at least at an upper-most position, part of the scavenging port 3*a* may open, avoiding full obstruction by the side wall of the piston 7.

Industrial Availability

The present invention is useful as the stratified scavenging two-cycle engine which can make exhaust gas cleaner.

What is claimed is:

1. A stratified, scavenging, two-cycle engine comprising:

a cylinder chamber to receive at least a fuel mixture for purposes of combustion to drive a piston received therein;

a crank chamber;

a fluid passage extending between the cylinder chamber and the crank chamber, wherein the fluid passage opens into the cylinder chamber at an orifice; and an air introduction passage, in fluid communication with the fluid passage, to introduce air to the fluid passage, wherein when the piston is at least in a vicinity of a first position, an uninterrupted path extends at least between the air introduction passage, via the orifice, to the crank chamber, and wherein when the piston is at the first position, a fuel mixture is subject to maximum compression.

2. An engine in accordance with claim 1, wherein the orifice is below the piston when the piston is at least at the first position.

3. An engine in accordance with claim 1, wherein the piston includes a formed notch, and when the piston is at least at the first position, the notch corresponds to the orifice so as to prevent complete obstruction of the orifice.

4. An engine in accordance with claim 1, wherein the piston includes a through-hole, and when the piston is at least at the first position, the through-hole corresponds to the orifice so as to prevent complete obstruction of the orifice.

5. A stratified, scavenging, two-cycle engine having a cylinder chamber and a crank chamber, the engine comprising:

a fluid passage extending between the cylinder chamber and the crank chamber, wherein the fluid passage opens into the cylinder chamber at an orifice;

an air introduction passage, in fluid communication with the fluid passage, to introduce air to the fluid passage; and a piston received within the cylinder for axial movement therein, wherein when the piston is at least in a vicinity of an upper-most position, an uninterrupted path extends at least between the air introduction passage, via the orifice, to the crank chamber.

6. An engine in accordance with claim 5, wherein the orifice is below the piston when the piston is at least at the upper-most position.

7. An engine in accordance with claim 5, wherein the piston includes a formed notch, and when the piston is at least at the upper-most position, the notch corresponds to the orifice so as to prevent complete obstruction of the orifice.

8. An engine in accordance with claim 5, wherein the piston includes a through-hole, and when the piston is at least at the upper-most position, the through-hole corresponds to the orifice so as to prevent complete obstruction of the orifice.

9. A method for scavenging combustion gases from a stratified, scavenging, two-cycle engine having a cylinder chamber to receive a piston, a crank chamber, a fluid passage extending between the cylinder chamber and the crank chamber, the fluid passage opening into the cylinder chamber at an orifice, an exhaust port in communication with the cylinder chamber, and an air introduction passage, in fluid communication with the fluid passage, to introduce air to the fluid passage, the method comprising the steps of:

moving the piston from a starting position to an uppermost position, whereby a fuel mixture volume within the cylinder chamber is compressed during such piston movement;

when the piston reaches approximately the uppermost position, igniting the fuel mixture volume using an ignition device, whereby the piston is then returned toward the starting position; and when the piston is approximately at the upper-most position, introducing air into the crank chamber through the orifice to clear any fuel mixture residing within the fluid passage at and near the orifice, wherein when the piston descends below the exhaust port, combustion gases flow from the cylinder chamber through the exhaust port, and wherein when the piston descends below the orifice, air within the fluid passage enters the cylinder chamber to further expel combustion gases through the exhaust port.

* * * * *